US006564583B2

(12) United States Patent
Gruber

(10) Patent No.: US 6,564,583 B2
(45) Date of Patent: May 20, 2003

(54) JEWELRY WITH GIRDLE-GROOVED STONE

(76) Inventor: Martin Gruber Gruber, 6725 Valjean Ave., Van Nuys, CA (US) 91406

( * ) Notice: Subject to any disclaimer, the term of this patent is extended or adjusted under 35 U.S.C. 154(b) by 0 days.

(21) Appl. No.: 09/841,672

(22) Filed: Apr. 24, 2001

(65) Prior Publication Data

US 2002/0152767 A1 Oct. 24, 2002

(51) Int. Cl.[7] ..... A44C 17/02
(52) U.S. Cl. ..... 63/26
(58) Field of Search ..... 63/26.33

(56) References Cited

U.S. PATENT DOCUMENTS

| | | | | | |
|---|---|---|---|---|---|
| 483,214 | A | * | 9/1892 | Gaynor | 63/13 |
| 521,370 | A | * | 6/1894 | Hensel | 63/26 |
| 837,615 | A | * | 12/1906 | Dover | 63/26 |
| 1,130,381 | A | * | 3/1915 | Cunningham | 63/29.1 |
| 1,211,239 | A | * | 1/1917 | Ryan | 63/32 |
| 1,560,414 | A | * | 11/1925 | Haan | 63/32 |
| 2,141,363 | A | | 12/1938 | Rigollet | |
| 3,875,760 | A | | 4/1975 | Jones | |
| 3,974,662 | A | * | 8/1976 | Avedissian | 63/15 |
| 4,738,240 | A | | 4/1988 | Aich | |
| 4,800,738 | A | * | 1/1989 | Bunz | 63/26 |
| 4,813,246 | A | | 3/1989 | Richards | |
| 4,821,533 | A | * | 4/1989 | Bonnefoy | 63/3 |
| 5,072,601 | A | | 12/1991 | Slowinski | |
| 5,115,649 | A | | 5/1992 | Amber | |
| 5,437,167 | A | | 8/1995 | Ambar | |
| 5,612,102 | A | | 3/1997 | Nakama | |
| 5,649,434 | A | | 7/1997 | Itzkowitz | |
| 5,690,477 | A | | 11/1997 | Haimoff | |
| 5,713,219 | A | | 2/1998 | Itzkowitz | |
| D415,977 | S | | 11/1999 | Itzkowitz | |
| 5,974,830 | A | * | 11/1999 | Colero | 63/26 |
| 6,029,474 | A | | 2/2000 | Bunz | |
| 6,112,552 | A | | 9/2000 | Hoffman | |

FOREIGN PATENT DOCUMENTS

| | | | |
|---|---|---|---|
| AT | 95954 | | 2/1924 |
| CH | 30497 | | 3/1904 |
| CH | 673 207 | A5 * | 8/1990 |
| EP | 0 189 874 | A1 * | 8/1986 |
| FR | 014247 | | 9/1984 |
| FR | 003384 | | 10/1986 |
| JP | 46-43086 | | 12/1971 |
| JP | 358148035 | A * | 9/1983 |

* cited by examiner

*Primary Examiner*—James R. Brittain
*Assistant Examiner*—Ruth C. Rodriguez
(74) *Attorney, Agent, or Firm*—Amster, Rothstein & Ebenstein

(57) ABSTRACT

Jewelry includes a stone which defines a crown, a pavilion and a girdle therebetween, the girdle having a 360° peripheral groove crown thereinto. A flexible wire has a first portion at least partially disposed within the groove and extending at least 90° (preferably at least 180°) about the stone, the mounting and the wire being secured together, thereby to secure together the stone and the mounting.

27 Claims, 5 Drawing Sheets

FIG. 3
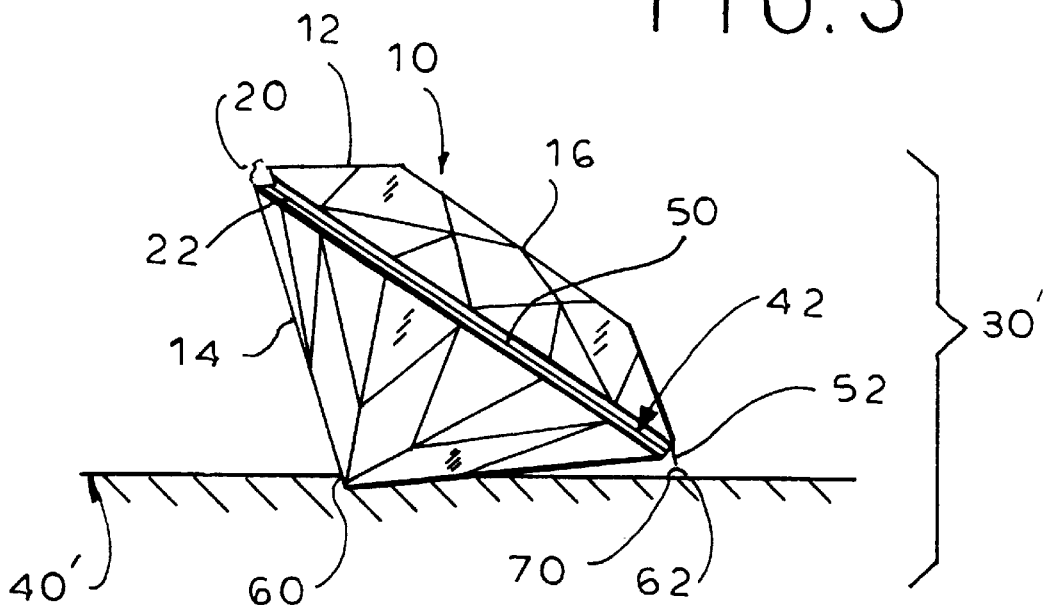
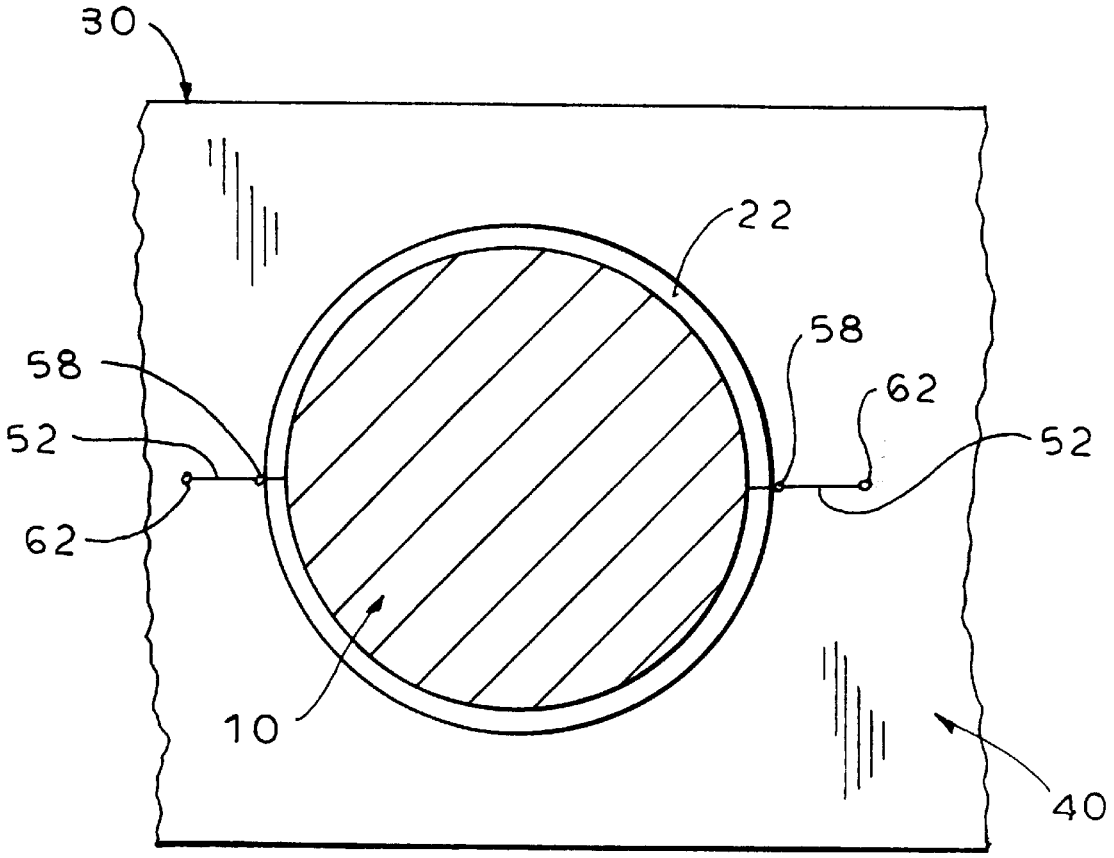
FIG. 2

FIG. 6
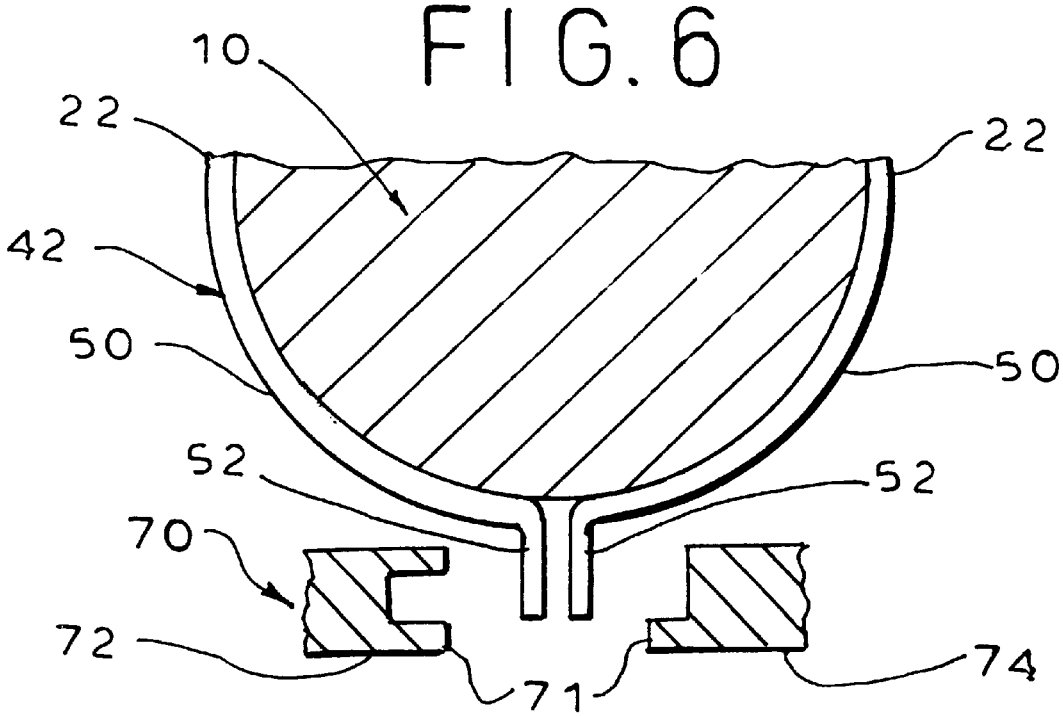
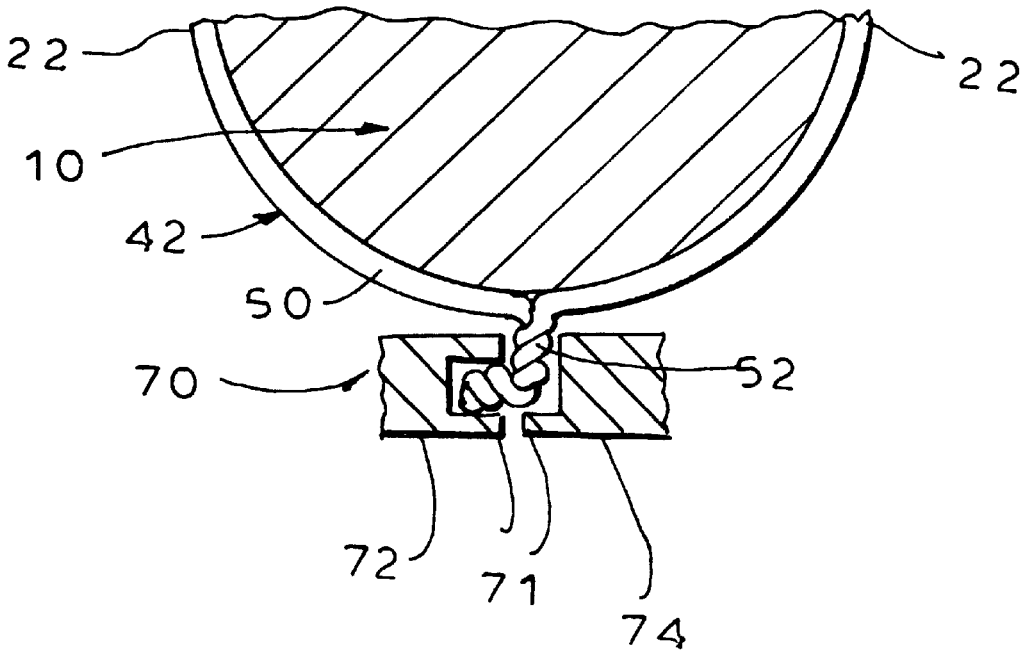
FIG. 7

FIG. 8
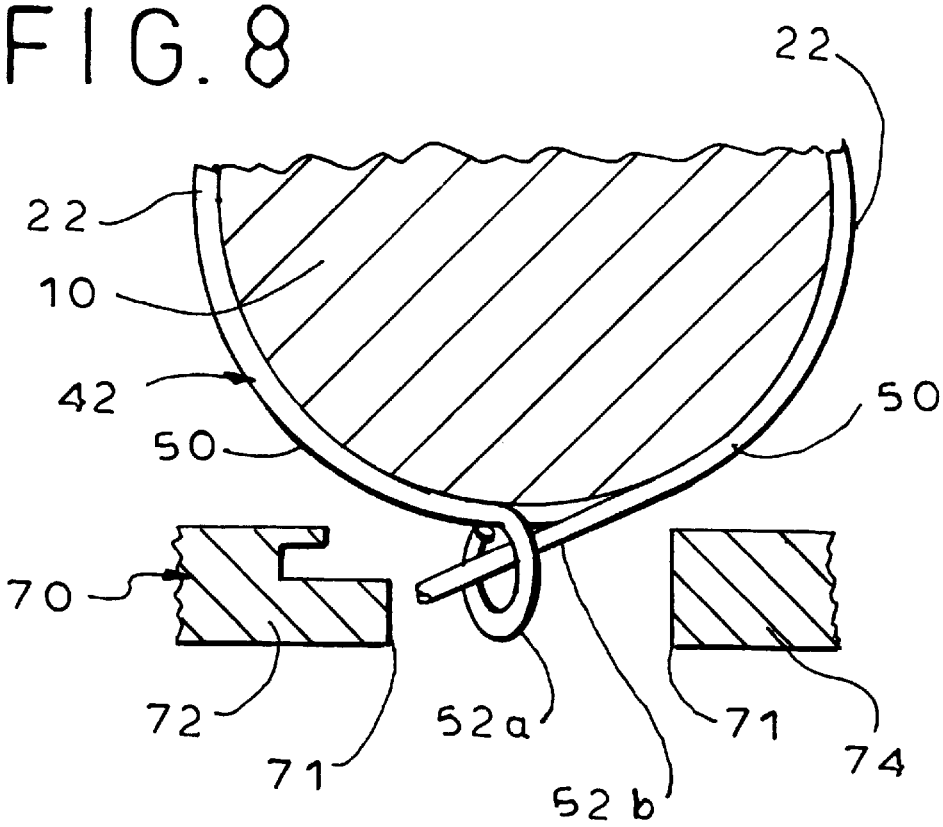
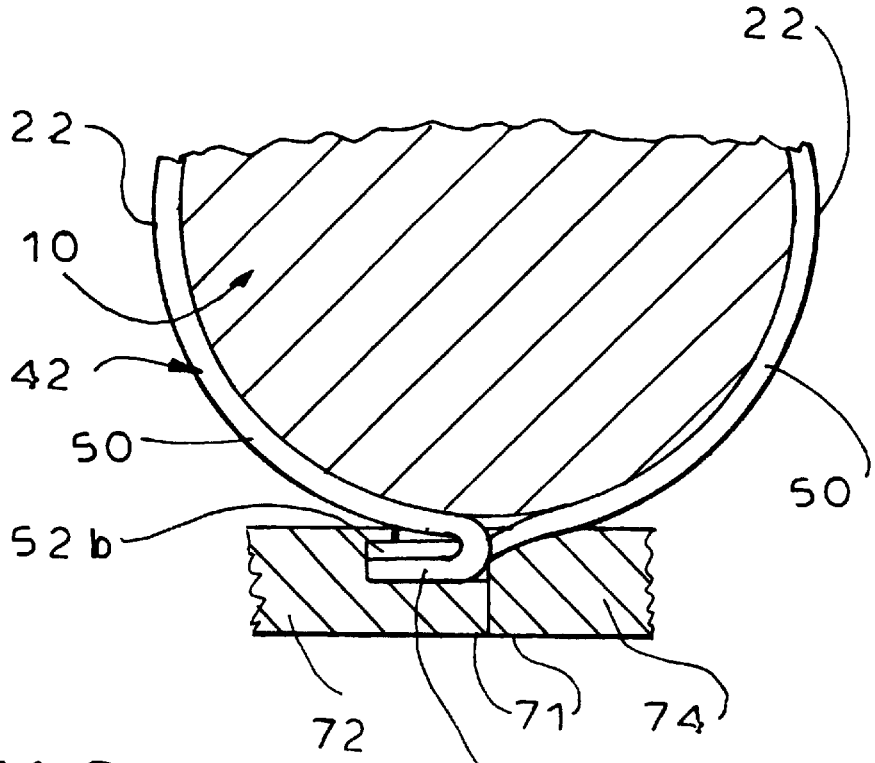
FIG. 9

JEWELRY WITH GIRDLE-GROOVED STONE

BACKGROUND OF THE INVENTION

The present invention relates to jewelry and, more particularly, to jewelry having means for mounting a stone with a peripherally grooved girdle.

Notwithstanding the thousands of years during which jewelry has been used to display precious, semi-precious and less than semi-precious stones, the mounting of stones for jewelry remain problematic. Where a stone is secured to a mounting by prongs of the mounting which have been bent over to entrap the stone, the very act of peening or swagging (i.e., bending the prong) to at least some degree weakens the prong so that it may fail at a later date (with possible loss of the stone), while the very presence of the many prong free ends extending over a portion of the table of the stone detracts from the aesthetic appearance of the stone. Further, most mountings are capable of retaining a stone only when the stone is in a fixed upright or vertical orientation (transverse relative to the mounting) and are not well suited for maintaining a stone in a horizontal orientation (generally parallel to the mounting).

Accordingly, it is an object of the present invention to provide jewelry in which the stone is secured to the mounting with a high degree of reliability.

Another object is to provide such jewelry which does not require the use of prongs.

A further object is to provide such jewelry wherein the stone may be mounted to the mounting in a horizontal or vertical orientation, as desired.

It is also an object of the present invention is to provide such jewelry which does not conceal any part of upper surface of the stone.

It is a further object to provide such jewelry which is easy to construct and maintain.

SUMMARY OF THE INVENTION

It has now been found that the above and related objects of the present invention are obtained in jewelry formed of four components: a stone, a mounting for mounting the stone, a flexible wire and securing means. The stone defines a crown, a pavilion, and a girdle therebetween, the girdle having a 360° peripheral groove ground thereinto. The flexible wire has a portion disposed totally within the groove and extending at least 90° about the stone. The securing means secures together the mounting and the wire, thereby to secure together the mounting and the stone.

In a preferred embodiment, the groove extends inwardly into the stone and is 0.25–0.35 mm (preferably about 0.3 mm) in height and is 0.35–0.45 mm (preferably about 0.4 mm) in depth. The groove is defined by a plurality of flats, each flat having a length not greater than 0.3 mm.

Preferably the wire has another portion, and the securing means secures together the mounting and another portion. The wire mounts the stone in either a generally transverse orientation relative to the mounting or a generally parallel orientation relative to the mounting. The wire preferably extends at least about 180° about the stone within the groove. Optimally the wire extends essentially 360° within the groove and has a pair of opposed ends welded together. It may be resiliently stretchable to receive therethrough one of the pavilion and the crown of the stone before entering the groove.

Typically the stone is round and defines at least sixteen additional facets relative to a conventional stone of a like cut. Preferably the wire is weldable to the mounting.

The present invention also encompasses jewelry comprising three components: a stone, a mounting for mounting the stone, and a wire. The stone defines a crown, a pavilion, and a girdle therebetween, the girdle having a 360° peripheral groove ground thereinto. The wire has a first portion and at least a second portion. The wire first portion is at least partially disposed within the groove and extends at least 300° about the stone. The wire second portion is disposed outside of said groove and mechanically secured to the mounting, thereby to secure together the mounting and the stone.

Preferably the wire is formed of metal, and the securing means welds or solders together the wire and the mounting means. The wire is substantially flexible, extends essentially 360° within the groove and has a pair of opposed ends twisted together to form the second portion. Alternatively, the wire is substantially stiff and formed of titanium.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 2 is a fragmentary sectional view thereof taken along the line 2—2 of FIG. 1;

FIG. 3 is a fragmentary side elevational view of a second embodiment of jewelry according to the present invention, partially in section, the stone being in a "horizontal" or parallel orientation;

FIG. 6 is a fragmentary side elevational view of jewelry, partially in section, showing the stone about to be secured to a mounting by a wire;

FIG. 7 is a view similar to FIG. 6, but after the wire ends have been twisted together and secured to the mounting;

FIG. 8 is a fragmentary side elevational view of jewelry, partially in section, showing the stone about to be secured to a mounting by a titanium wire; and FIG. 9 is a view similar to FIG. 8, but after the mounting is closed on the wire.

DETAILED DESCRIPTION OF THE PREFERRED EMBODIMENTS

Figure 1:
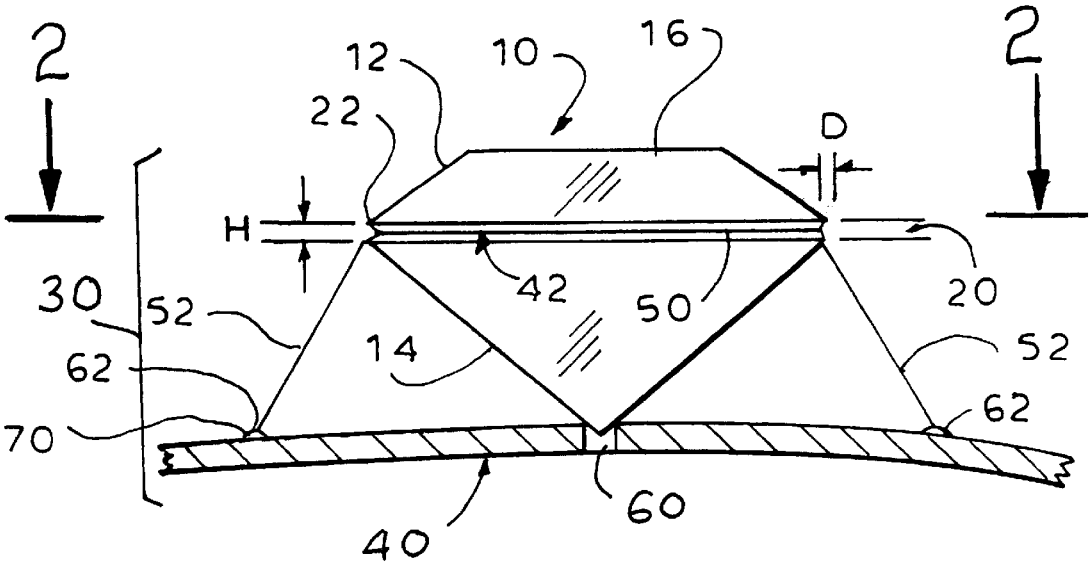
FIG. 1 is a fragmentary side elevational view of a first embodiment of jewelry according to the present invention, partially in section, the stone being in a vertical orientation.

Referring now to the drawing, and in particular to FIGS. 1 and 3 thereof, therein illustrated is a stone according to the present invention, generally designated by the reference numeral 10. Using conventional jewelry terminology, in an upright or vertical orientation the stone 10 defines a crown or upper portion 12, a pavilion or lower portion 14 and a girdle or intermediate portion 20 therebetween. In a conventional brilliant cut round stone, the girdle 20 is the widest portion of the stone; the table or top surface 16 of the stone would be 52.4–57.5% of the girdle diameter, the crown height being approximately 16% thereof and the pavilion height being approximately 43% thereof. The girdle/crown angle (known as the crown angle) is 33.7–35.8°, while the girdle/pavilion angle (known as the pavilion angle) is 42.2–43.8°. While the present invention is particularly well-suited for use with round stones such as brilliant cut diamonds, it is also useful with diamonds and other precious, semi-precious, and less than precious stones having different cuts such as marquise, princess, baguette cuts, etc.

Figure 4:
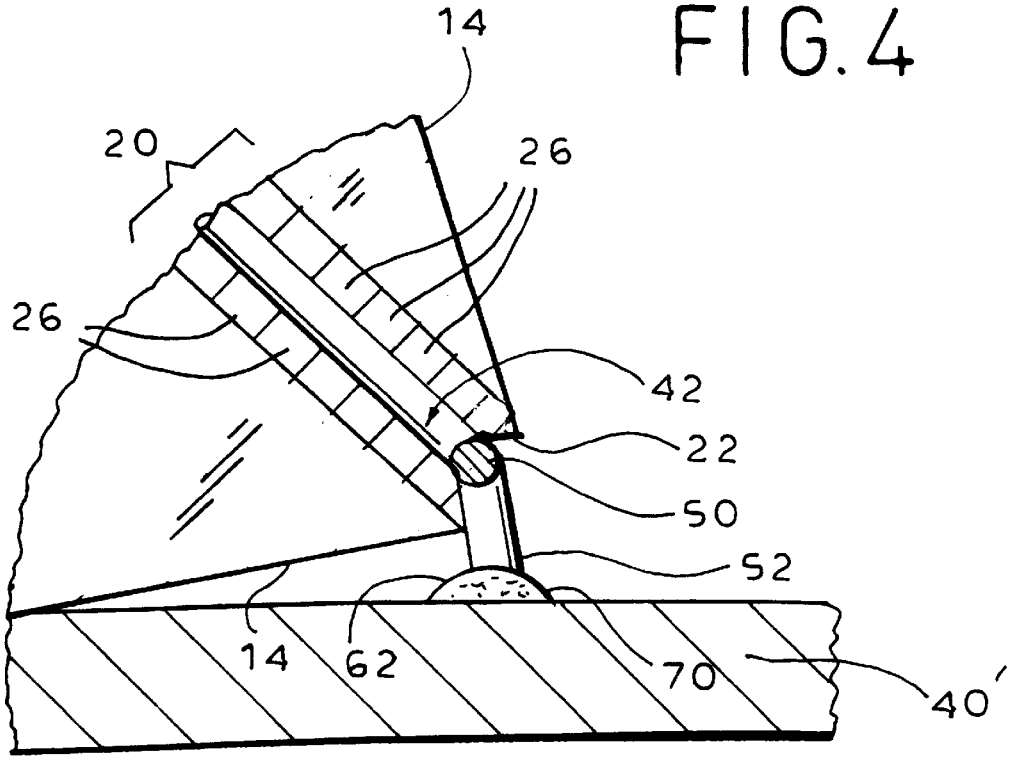
FIG. 4 is a fragmentary side elevational view of the jewelry of FIG. 3, to a greatly enlarged scale.

The stone 10 according to the present invention has a groove 22 ground into the stone at the girdle 20. The groove 22 extends 360° about the girdle and extends inwardly into the stone 10. While the precise dimensions may vary with the size of the stone, typically the groove is about 0.3 mm in height (see H of FIG. 1) and about 0.4 mm in depth (see D of FIG. 1). The groove 22 is in fact defined by a plurality of flats 26 (as illustrated in FIG. 4), with each flat having a length of at least 0.3 mm in order to avoid the formation of sharp (and therefore cutting) angles.

While the groove 22 may be cut or ground into the girdle 20 of a conventional stone, preferably the stone 10 used in the present invention is specially configured and dimensioned for this purpose. Since the girdle of a stone is often no more than a relatively thin line (theoretically a plane formed by the meeting of the facets of the crown and the facets of the pavilion), preferably a reconfigured stone 10 according to the present invention has a more substantial, thicker girdle and a pavilion of greater length. Thus, the stone for use in the present invention preferably has additional facets on the extra height of the pavilion (preferably at least 16 additional facets relative to a conventional stone of like cut) to compensate for the loss of stone which takes place during cutting of the groove. It will be appreciated that the additional faceting, while preferred for diamonds, is generally not required in the case of other stones. To avoid dead spots in a diamond, the ideal 47° angle for the cutting of facets is preferably reduced to 35°.

Referring now to FIGS. 1 and 3, therein illustrated are jewelry according to the present invention, a first embodiment generally designated 30 and a second embodiment generally designated 30'. In addition to a stone 10, as described hereinabove, each embodiment 30, 30' includes a mounting, generally designated 40, 40', respectively, for mounting the stone 10, and a flexible wire, generally designated 42. Although preferred designs of the mountings 40, 40' are illustrated in FIGS. 1 and 3, respectively, clearly the mountings may be of any configuration and dimensions which mount the stone 10 according to the principles of the present invention.

The wire 42 is preferably formed of a flexible (or at least swaggable) metal having a sufficiently high tensile strength for reliably securing together the stone 10 and mounting 40, 40'. Preferred metals for the wire 42 include platinum and silver, as well as alloys thereof having the requisite properties. The wire 42 is preferably of circular cross-section, although other cross-sections may be useful for particular applications. The wire 42 preferably has a diameter of approximately 0.4 mm.

The wire 42 has a first portion 50, preferably adjacent one end thereof, and a second portion 52, preferably adjacent an opposite end thereof. The first wire portion 50 is at least partially disposed within the groove 22 and extends at least 90° about the stone 10 at the girdle 20 thereof. The second wire portion 52 is secured to the mounting 40, 40' such that the wire 42 secures together the stone 10 and the mounting.

The wire 42 may mount the stone 10 in a generally transverse orientation relative to the mounting 40, as illustrated in FIG. 1, or in a generally parallel orientation relative the mounting 40', as illustrated in FIG. 3. When the stone 10 is mounted in the transverse orientation of FIG. 1, the first wire portion 50 is more-or-less invisible to one looking down on the table 13 of the stone 10 as the crown 12 generally hides the first wire portion 50; however, in the parallel orientation of FIG. 3 the first wire portion 50 is more visible to one looking down on such jewelry. Accordingly, when the stone 10 is in the parallel orientation relative to the mounting 40', the aesthetic nature of the wire 42 becomes more significant.

Regardless of the orientation of the stone 10 relative to the mounting, the wire must extend at least 90° about the stone 10 so as to force the stone 10 against the mounting 40, 40'. Preferably, the first wire portion 50 extends at least about 180° about the stone 10 within the groove 22. Especially when the stone 10 is in a transverse orientation relative to the mounting 40, the first wire portion 50 preferably extends completely—that is, essentially a full 360°—about the stone, with at least a major length thereof being within the groove 22. As a general rule, the greater the percentage of the first wire portion 50 which is hidden within the groove 22, the better the aesthetic effect. Regardless of the orientation of the stone 10 relative to the mounting, where the first wire portion 50 extends a full 360° about the stone within the groove 22, the first wire portion 50 may define a closed loop within the groove 22 either by itself (e.g., by being twisted on itself) or by welding, bonding (e.g., with solder 58), or the like.

The mounting 40, 40' may be indented or grooved at 60 to receive a part of the stone 10—for example, the pointed base of the pavilion 14 when the stone is in the upright orientation of FIG. 1 or a longitudinal edge of the pavilion 14 when the stone is in the horizontal orientation of FIG. 3—to assist the wire 42 in the stabilization of the stone 10 relative to the mounting.

The second wire portion 52 may be secured to the mounting 40, 40' by any of a variety of reliable means. Thus the second wire portion 52 may be welded or bonded (e.g., by solder 62) to the mounting or simply physically engaged by the mounting for example, by a mounting hook (not shown) extending substantially around the wire, either with or without adhesive means).

A stone 10 in the upright orientation may be stabilized in the desired orientation on mounting 40 by a single second wire portion 52; however preferably at least two second wire portions 52, and possibly as many as four, may be used to enhance the stability (with the point of the pavilion being received in the aperture or recess 60 or mounting 40), as illustrated in FIGS. 1 and 2. Similarly, a stone 10 in the horizontal orientation on mounting 40' may be stabilized in the desired orientation on mounting 40' by the use of a single second wire portion 52; however, preferably two or more second wire portions 52' may be used to further stabilize the stone 10 (along with an edge of the pavilion being received in a groove 60 of mounting 40') as illustrated in FIGS. 3 and 4.

It will be appreciated that the second wire portion 52 may be either an original and integral portion of the wire 42 or initially a separate and distinct portion of a second wire which is later bonded, welded, soldered or otherwise secured to the first wire portion 50.

In order to effectively stabilize the orientation of the stone 10, the first wire portion 50 disposed totally within the groove 22 should extend at least about 90° about the stone, preferably at least about 180° about the stone, and optimally 300° or essentially 360° about the stone. This may vary according to the extent to which the base or tip of the pavilion 14 of the stone is received within an aperture 60 of a mounting 40 or the extent to which a side edge of the pavilion 14 is received within a groove or recess 60 of a mounting 40'. For example, a wire first portion 50 extending only 90° about the stone may be sufficient where the mounting 40 itself extends substantially about the stone, and the wire 42 thus has only to urge the stone against the mounting. As another example, the groove 60 in a mounting 40' may be configured and dimensioned to receive a substantial proportion of the pavilion edge and simply have the entrance into the groove 22 closed off by a resiliently stretchable wire 42. The pavilion 14 of the stone 10 is then simply forced into the groove 22, with the wire 42 initially stretching to receive the pavilion and then resiliently shrinking to enter the groove.

The jewelry according to the present invention includes means 70 for securing together the mounting 40, 40' and the wire 42, thereby to secure together the mounting and the stone 10. The securing means 70 may be conceptualized either as a portion of the mounting 40, 40' or as a separate and distinct element secured to the mounting. The securing means 70 may simply be a weld or solder 62, as illustrated in FIGS. 1–5. Alternatively, however, the securing means may be a mechanism 71 secured to the mounting 40, 40' and movable between a wire-engaging orientation and a wire-releasing orientation.

Referring now to FIGS. 6 and 7, therein illustrated is a wire 42 having a first portion 50 within the groove 22 of a stone 10 and a second portion 52 formed by the free ends of the wire 42 extending out of the groove 22. As shown in FIG. 7, the free ends are twisted together. The twisted free ends are then trapped by a securing mechanism 71 including first and second jaws 72, 74 which are movable between a wire-receiving/wire-releasing orientation (wherein they define a gap therebetween adapted to receive/release the twisted together second wire portions 52), as illustrated in FIG. 6 and a wire-retaining/wire-engaging orientation (wherein the first and second jaws 72, 74 are closely adjacent or in contact, with portions thereof grasping the twisted second wire portions 52 to prevent their withdrawal from the jaws 72, 74, and hence to prevent their withdrawal from the mounting), as illustrated in FIG. 7.

Referring now to FIGS. 8 and 9, the second wire portions 52 need not be twisted together as illustrated in FIG. 7. For example, as best seen in FIG. 8, one second wire portion 52*a* may be in the form of a loop adapted to receive therethrough the other second wire portion 52*b*. Then the second wire portions 52*a*, 52*b* are disposed intermediate the jaws 72, 74 of the securing mechanism 71 in the wire-receiving/wire-releasing orientation, and the jaws 72, 74 are then forcibly closed into the wire-retaining/wire-engaging orientation to deform the loop defined by the second wire portion 52*a* and collapse it upon the other second wire portion 52*b*, so that both of the second wire portions 52*a*, 52*b* are locked together and trapped between the closed jaws 72, 74.

The securing mechanism of FIGS. 8 and 9 may be utilized with a wire which is substantially stiff, for example, a wire formed of titanium. In this instance, preferably the first wire portion extends at least 300° about the stone, and the deformation of the titanium wire during closure of the securing mechanism 71, if there is any, is minimal.

Figure 5:
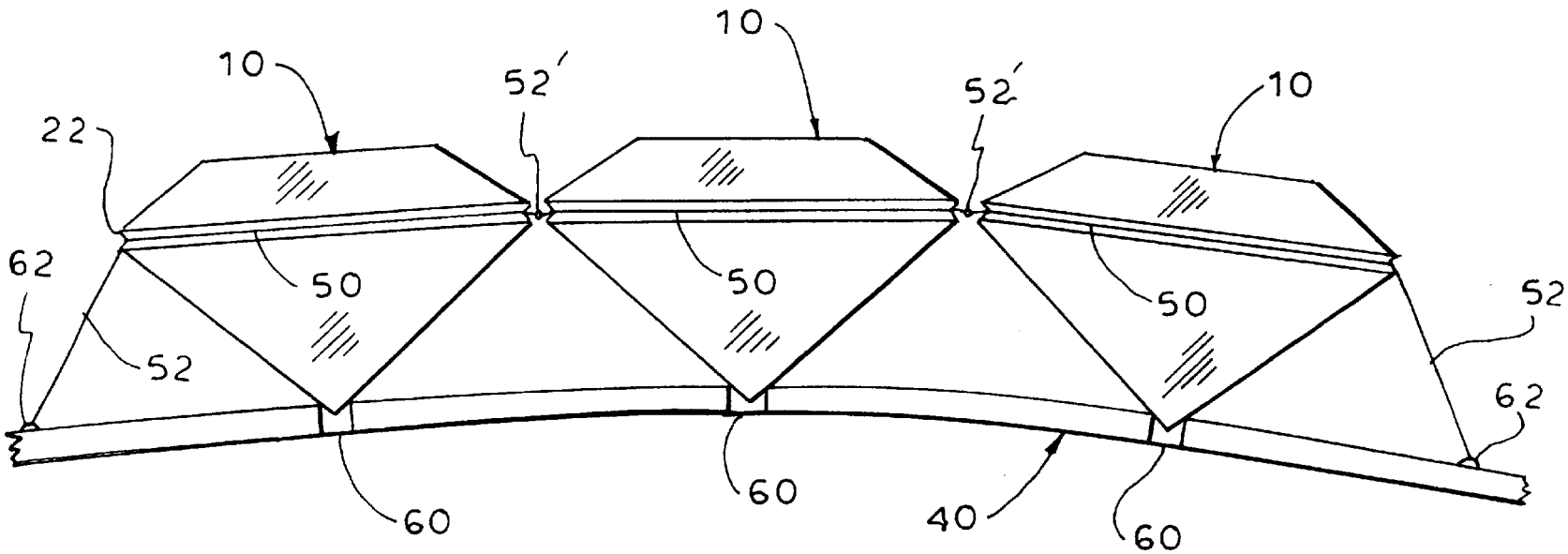
FIG. 5 is a fragmentary side elevational view of jewelry, partially in section, showing three interconnected stones, each in a vertical or transverse orientation relative to the mounting.

Interesting effects may be obtained by mounting the stone 10 to a mounting 40, 40' which is itself either a wire secured to another stone or the prong of a conventional mounting. In the first instance, as illustrated in FIG. 5, a plurality of stones 10 may be secured together (in either a straight or curved line) with the wire 42 of each intermediate stone 10 treating the wire 42 of the adjacent stone(s) as a mounting. Thus, the first wire portions 50 about each of two adjacent stones in a series may be secured together by an abbreviated (short) second wire portion 52' between the stones, with full length second wire portions 52 securing only the two end stones in the series to the mounting 40, 40'. In the second instance, a conventionally mounted stone (for example, a large center stone conventionally mounted through the use of a plurality of prongs) may have adjacent smaller stones according to the present invention secured to respective conventional prongs about the center stone using the second wire portions 52. Clearly the jewelry of the present invention can be formulated in a wide variety of novel and aesthetic configurations making use of the grooved girdle and flexible wire.

Typically the wire 42 is inelastic (that is, non-stretchable) so that the first wire portion 50 securely grasps the stone 10. However, in certain instances the wire may be resilient (that is, elastically stretchable) so that the first wire portion 50 (or a loop thereof) may be forcibly stretched to receive therepast (or therethrough) one of the pavilion 14 and crown 12 before it is allowed to contract and enter into the groove 22.

Where the wire is formed of titanium (which is substantially stiff and cannot be readily soldered to gold or platinum), the titanium wire may be formed as an omega design. A first wire portion (formed by the loop of the omega) extends at least about 300° about the stone and is mechanically maintained in the groove by the stiffness of the titanium, and a second wire portion (formed by the free ends of the omega) outside of the groove is captured by the mounting to stop them from opening up and to mechanically secure together the stone and the mounting.

To summarize, the present invention provides jewelry in which a stone is secured to a mounting with a high degree of reliability and without the use of prongs so that the table of the stone is not concealed by the prong free ends. The stone may be mounted to the mounting in either a horizontal or vertical orientation, as desired. The jewelry is inexpensive and easy to construct and maintain.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. Jewelry comprising:

(A) a stone defining a crown, a pavilion, and a girdle therebetween, said girdle having a 360° peripheral groove ground thereinto;

(B) means for mounting said stone without a prong; and (C) a flexible wire having a length thereof disposed totally with said groove and extending at least 90° about said stone; and (D) means securing together said mounting means and said wire, thereby to secure together said mounting means and said stone.

2. The jewelry of claim 1 wherein said groove extends inwardly into said stone.

3. The jewelry of claim 1 wherein said groove is 0.25–0.35 mm in height.

4. The jewelry of claim 1 wherein said groove is 0.35–0.45 mm in depth.

5. The jewelry of claim 1 wherein said groove is about 0.3 mm in height and about 0.4 mm in depth.

6. The jewelry of claim 1 wherein said groove is defined by a plurality of flats, each said flat having a length not greater than 0.3 mm.

7. The jewelry of claim 1 wherein said wire has another length, and said securing means secures together said mounting means and said another length.

8. The jewelry of claim 1 wherein said stone is secured in a generally transverse orientation relative to said mounting means.

9. The jewelry of claim 1 wherein said stone secured in a generally parallel orientation relative to said mounting means.

10. The jewelry of claim 1 wherein said wire extends essentially 360° within said groove and has a pair of opposed ends welded together.

11. The jewelry of claim 1 wherein said wire extends at least about 180° about said stone within said groove.

12. The jewelry of claim 1 wherein said wire is resiliently stretchable and stretches to receive therethrough one of said pavilion and said crown before entering said groove and returning to its original length.

13. The jewelry of claim 1 wherein said stone is round.

14. The jewelry of claim 1 wherein said stone defines at least sixteen additional facets relative to a conventional stone of like cut.

15. The jewelry of claim 1 wherein said wire is formed of a metal, and said securing means welds or solders together said wire and said mounting means.

16. The jewelry of claim 1 wherein said wire is flexible but non-resilient and non-elastic.

17. Jewelry comprising:

(A) a stone defining a crown, a pavilion, and a girdle therebetween, said girdle having a 360° peripheral groove ground thereinto, said groove extending inwardly into said stone and being about 0.3 mm in height and about 0.4 mm in depth, said groove being defined by a plurality of fiats, each said fiat having a length not greater than 0.3 mm;

(B) means for mounting said stone without a prong; and (C) a flexible wire having a length thereof disposed totally within said groove and extending at least about 180° about said stone; and (D) means securing together said mounting means and said wire with said stone mounted in a fixed orientation relative to said mounting means, thereby to secure together said mounting means and said stone.

18. The jewelry of claim 17 wherein said wire extends essentially 360° about said stone within said groove and has a pair of opposed ends welded together.

19. The jewelry of claim 17 wherein said wire is resilient and stretches to receive therethrough said pavilion before entering said groove.

20. The jewelry of claim 17 wherein said stone is round.

21. The jewelry of claim 17 wherein said stone defines at least sixteen additional facets relative to a conventional stone of like cut.

22. The jewelry of claim 17 wherein said wire is formed of metal, and said securing means welds or solders together said wire and said mounting means.

23. The jewelry of claim 17 herein said wire is flexible but non-resilient and non-elastic.

24. Jewelry comprising:

(A) a stone defining a crown, a pavilion, and a girdle therebetween, said girdle having a 360° peripheral groove ground thereinto;

(B) means for mounting said stone without a prong; and (C) a wire having a first length thereof at least partially disposed within said groove and extending at least 300° about said stone and at least a second length thereof disposed outside of said groove and mechanically secured to said mounting means, thereby to secure together said mounting means and said stone.

25. The jewelry of claim 24 wherein said wire is substantially stiff and formed of titanium.

26. The jewelry of claim 24 wherein said wire is substantially flexible, extends essentially 360° within said groove and has a pair of opposed ends twisted together to form said second length.

27. The jewelry of claim 24 herein said wire is flexible but non-resilient and non-elastic.

* * * * *